US010427845B2

(12) United States Patent
McPherson

(10) Patent No.: US 10,427,845 B2
(45) Date of Patent: Oct. 1, 2019

(54) TAMPER EVIDENT CLOSURE

(71) Applicant: Obrist Closures Switzerland GmbH, Reinach (CH)

(72) Inventor: Alexander Donald Meiklem McPherson, Falkirk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 14/648,671

(22) PCT Filed: Nov. 14, 2013

(86) PCT No.: PCT/EP2013/073820

§ 371 (c)(1),
(2) Date: May 29, 2015

(87) PCT Pub. No.: WO2014/082863

PCT Pub. Date: Jun. 5, 2014

(65) Prior Publication Data

US 2015/0298876 A1 Oct. 22, 2015

(30) Foreign Application Priority Data

Nov. 30, 2012 (GB) ..... 1221610.7

(51) Int. Cl.

| | |
|---|---|
| ***B65D 55/02*** | (2006.01) |
| ***B65D 41/34*** | (2006.01) |
| ***B65D 49/04*** | (2006.01) |

(52) U.S. Cl.

CPC ..... *B65D 55/02* (2013.01); *B65D 41/348* (2013.01); *B65D 41/3423* (2013.01);
(Continued)

(58) Field of Classification Search

CPC ..... B65D 55/02; B65D 41/3423; B65D 41/3457; B65D 41/3442; B65D 41/348; B65D 49/04
(Continued)

(56) References Cited

U.S. PATENT DOCUMENTS 3,439,825 A * 4/1969 Glensky ..... B65D 41/42 215/251
3,517,847 A 6/1970 Guala
(Continued)

FOREIGN PATENT DOCUMENTS

AU 464605 B2 7/1973
GB 2158424 A 11/1985
(Continued)

OTHER PUBLICATIONS

Japan Patent Office, Office Action Issued in Application No. 2015-544408, dated Sep. 1, 2016, 7 pages.
(Continued)

*Primary Examiner* — James N Smalley
(74) *Attorney, Agent, or Firm* — McCoy Russell LLP

(57) ABSTRACT

A closure (10) is provided. The closure (10) comprises a body portion (20) having engagement means (45) for engagement with a container(15), and a shell for engagement with the body portion (20), wherein the shell comprises securing means (80) arranged in use to secure the engagement means (45) onto the container(15). The container (15) may be a bottle. The body portion (20) may be a pourer fitment. The engagement means (45) may comprise at least one clip. The securing means (80) may comprise a bead.

15 Claims, 12 Drawing Sheets

(52) U.S. Cl.
CPC ..... *B65D 41/3442* (2013.01); *B65D 41/3457* (2013.01); *B65D 49/04* (2013.01)

(58) Field of Classification Search
USPC ..... 215/43, 276, 317, 321; 220/319, 320
See application file for complete search history.

(56) References Cited

U.S. PATENT DOCUMENTS

| | | | | |
|---|---|---|---|---|
| 5,799,810 | A * | 9/1998 | de Pous | B05B 11/3049 215/274 |
| 5,823,373 | A * | 10/1998 | Sudo | B29C 45/0081 215/249 |
| 2003/0178442 | A1* | 9/2003 | Thomson | B65D 49/04 222/153.14 |
| 2006/0273115 | A1* | 12/2006 | De Pous | B05B 11/0008 222/321.9 |
| 2009/0028902 | A1 | 1/2009 | Cham et al. | |
| 2011/0006029 | A1* | 1/2011 | Granger | B65D 49/04 215/18 |
| 2011/0031209 | A1* | 2/2011 | Arecco | B65D 47/122 215/330 |
| 2011/0259844 | A1* | 10/2011 | Skelton | B65D 49/04 215/201 |

FOREIGN PATENT DOCUMENTS

| | | | |
|---|---|---|---|
| JP | S52142059 | U1 | 10/1911 |
| JP | S5085548 | U1 | 7/1975 |
| JP | H09238998 | A | 9/1997 |
| JP | 2008505811 | A | 2/2008 |
| WO | 9804474 | A2 | 2/1998 |

OTHER PUBLICATIONS

ISA European Patent Office, International Search Report Issued in Patent Application No. PCT/EP2013/073820, dated Apr. 2, 2014, WIPO, 9 pages.

* cited by examiner

TAMPER EVIDENT CLOSURE

CROSS REFERENCE TO RELATED APPLICATIONS

The present application is a U.S. National Phase of International Patent Application Ser. No. PCT/EP2013/073820, entitled "TAMPER EVIDENT CLOSURE," filed on Nov. 14, 2013, which claims priority to United Kingdom Patent Application No. 1221610.7, entitled "TAMPER EVIDENT CLOSURE," filed on Nov. 30, 2012, the entire contents of each of which are hereby incorporated by reference for all purposes.

FIELD OF THE INVENTION

The present invention relates generally to a closure for a container and particularly to a closure with means for preventing the closure being removed from a container.

BACKGROUND OF THE INVENTION

There is an increasing demand for closures to prevent, or at least resist, the contents of containers being tampered with, once the closure is applied to a container. It is therefore desirable to provide an improved tamper resistant closure.

SUMMARY OF THE INVENTION

According to an aspect of the invention, there is provided a closure comprising: a body portion having engagement means for engagement with a container, and a shell for engagement with the body portion, wherein the shell comprises securing means arranged in use to secure the engagement means onto the container.

The body portion may be a pourer fitment.

The engagement means may be at least one clip for securing the pouring fitment to the neck of a container. The container may be a bottle.

The securing means may be a bead. The bead may be arranged such that in use, it urges the at least one clip into engagement with the neck of the container.

The at least one clip may comprise a projection extending away from the body portion to engage the neck of the container.

The bead may be arranged such that in use, it urges the projection into engagement with the neck of the container.

The closure may comprise a plurality of engagement means.

The body portion may be made of polycarbonate. The body portion may be made of polyethylene terephthalate (PET).

Polycarbonate material may be used for the body portion of the closure, as it is can snap fit onto a glass finish of a container (bottle) and will not taint the contents (beverage) within the container. PET can also be snapped on and does not taint the contents. Further, by providing the securing means to secure the PET body portion to the container, if the PET body portion is attacked by heat, for example with a hair dryer, in an attempt to deform the PET body portion to remove it from the container, the securing means holds the engagement means of the body portion in place and prevents removal.

The shell may be made from metal with the bead formed in the shell.

Different aspects and embodiments of the invention may be used separately or together.

BRIEF DESCRIPTION OF THE DRAWINGS

The present invention will now be more particularly described, by way of example, with reference to the accompanying drawings, in which.

DESCRIPTION

Figure 1:
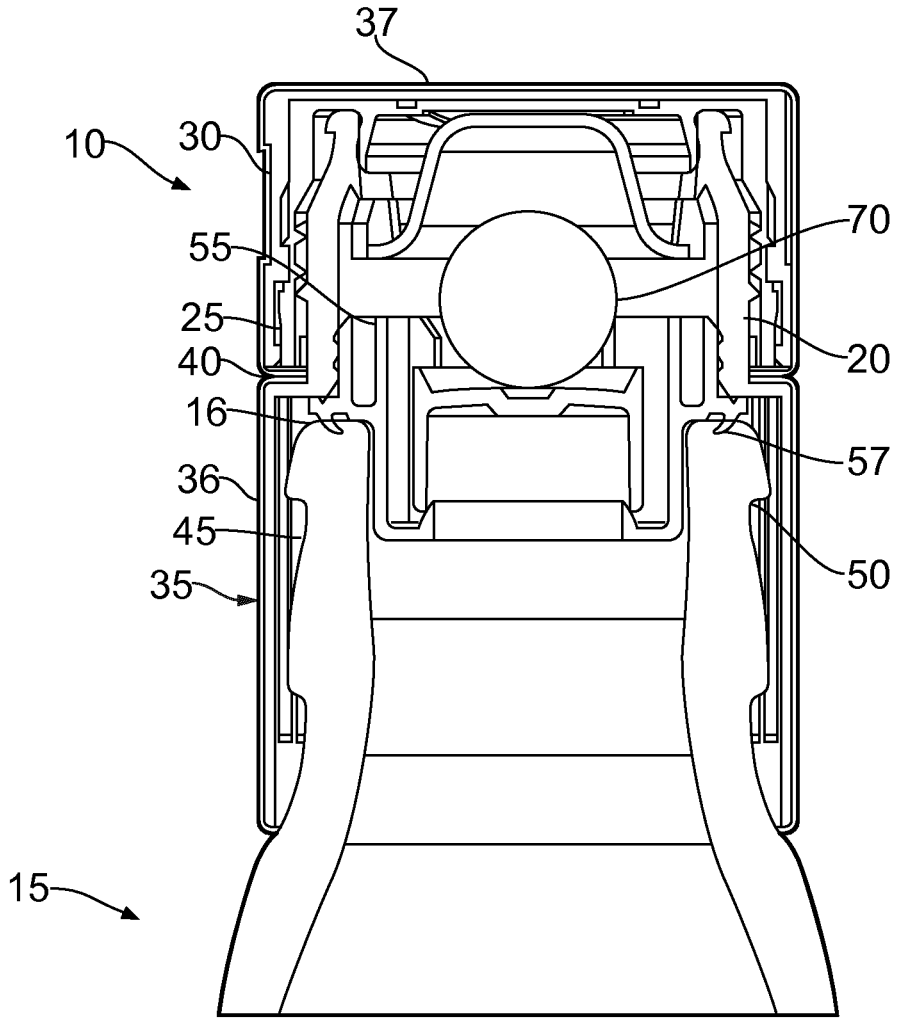
FIG. 1 is a section of a closure in a first, unopened position.

Referring first to FIG. 1 there is shown a closure generally indicated 10 secured onto a container neck 15. The container may be a bottle.

The closure 10 comprises a main body 20, an inner part 25 and an outer part 30. A metal shell 35 forms an outer casing to the closure and is divided into a cylindrical lower part 36 and a cup-shape second part 37. The parts 36, 37 are separated at a split line 40 formed by a cutting process once the shell 35 has been applied to the first and second portions of the closure.

Together the body 20 and the shell part 36 comprise a second portion and the inner and outer parts plus the shell part 37 comprises a cap-like first portion.

The main body 20 is fixed onto the container neck 15 by clips 45 which project inwardly and engage under a shoulder 50. The clips 45 comprise engagement means.

A valve housing 55 is clipped into the main body 20 and includes a sealing lip 57 which seals against the top surface 16 of the container neck 15.

A float valve 65 is housed in the housing 55 and can seal against a valve seat 60 to prevent re-filling of the container. A valve control ball 70 is located on top of the float valve 65.

In use, the second part 37 of the shell 35 is rotated. This unscrews the outer part 30 from the inner part 25. The outer part unscrews until a locking mechanism described in more detail below locks it to the inner part 25. With the outer and inner parts locked together the inner part 25 can then be unscrewed from the main body 20.

When the cap (shell part 37/outer part 30/inner part 25) is screwed back onto the main body 20, a gap G is formed between the first and second shell parts 36, 37. This is because the outer part 30 cannot be screwed completely back down onto the inner part 25 by virtue of the locking mechanism. In addition, the bottom of the inner part 25 protrudes below the bottom of the outer part 30 so as to be visible in the gap G.

The gap G formed between the shell parts 36, 37 is unobstructed in the sense that there is no obstruction member trapped between the parts 36, 37.

Figure 4A:
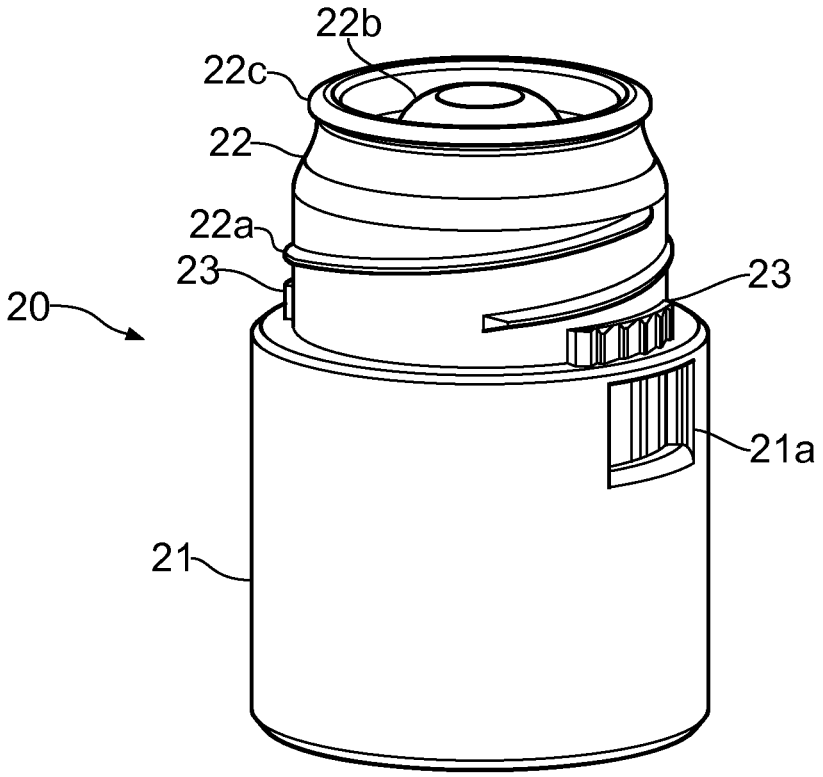
FIG. 4A is a perspective view of a second portion of the closure.
Figure 4B:
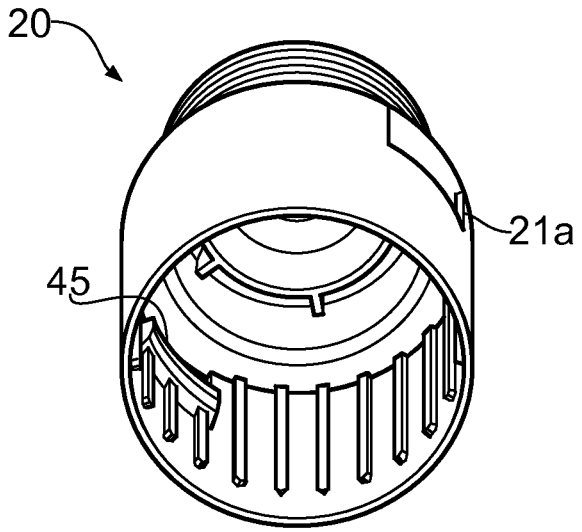
FIG. 4B is an underside perspective view of the second portion shown in FIG. 4A.

Referring now to FIGS. 4A and 4B the main body 20 is shown in more detail.

The body portion 20 comprises a lower engagement portion 21 and an upper flow regulation portion 22.

Figure 2:
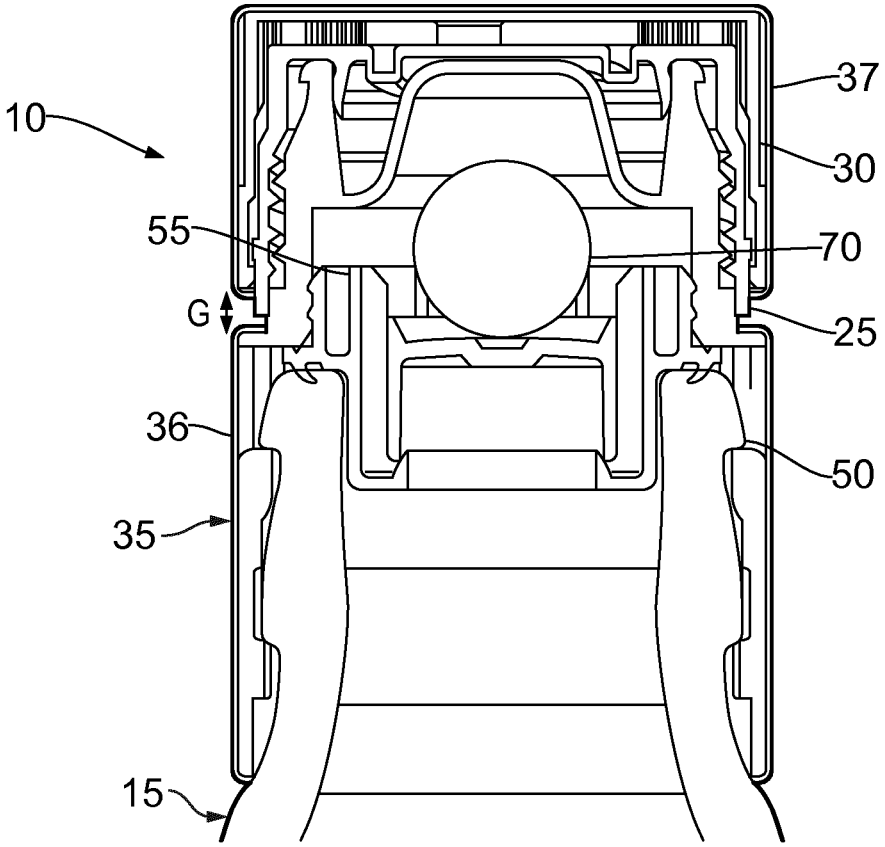
FIG. 2 is a section of the closure of FIG. 1 shown in a second, opened position.
Figure 3:
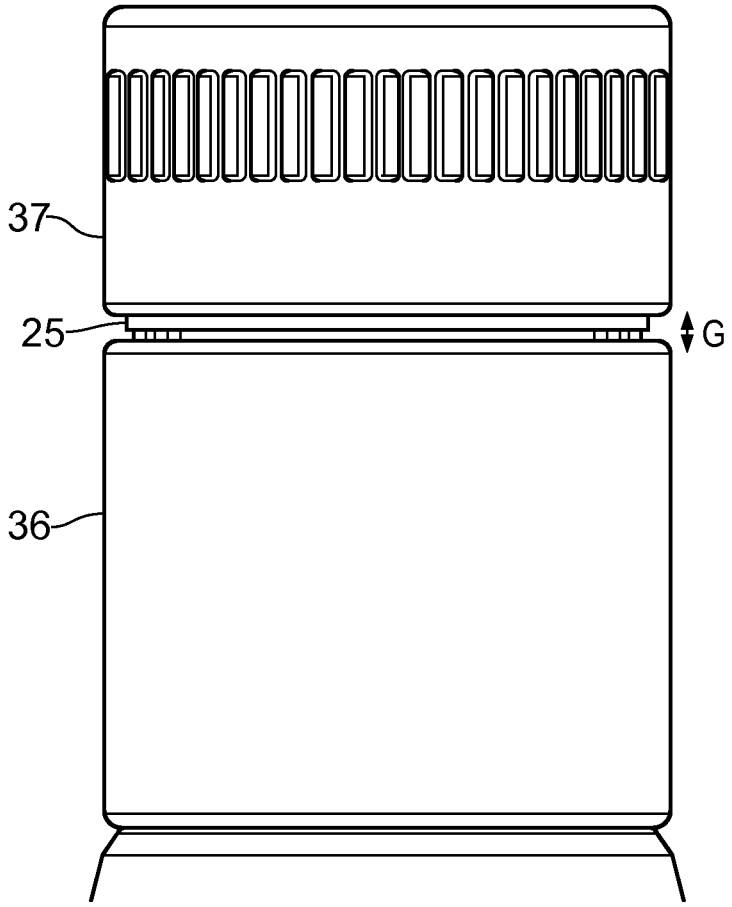
FIG. 3 is a side elevation of the opened closure shown in FIG. 2.

The lower portion 21 comprises a generally cylindrical body having two diametrically opposed clips, each comprising a window 21*a* and each of which having at a lower edge a ledge 45 for engagement under the container neck shoulder 50 as shown in FIGS. 1 and 2. In addition, the interior surface of the lower portion 21*a* has a plurality of mutually spaced axial ribs 21*b* which lock onto the outer surface of the container neck in use to prevent relative rotation between the container neck and the body 20.

The upper portion 22 of the main body 20 is generally frusto-conical in shape and has external screw threads 22*a*. At the base of the portion 22 where it joins the portion 21, two sets of ratchet teeth 23 are positioned.

The teeth 23 engage corresponding teeth on the inner part 25 to prevent it from rotating whilst the outer part 30 is being rotated for the first time in use. Only after the outer part 30 has locked against the inner part 25 can the inner part 25 be rotated relative to the body 20. At the opposite end of the portion 22 a dome-shape flow regulator 22*b* is positioned in the aperture. The aperture itself is defined by a circumferential pouring lip 22*c*.

Figure 5A:
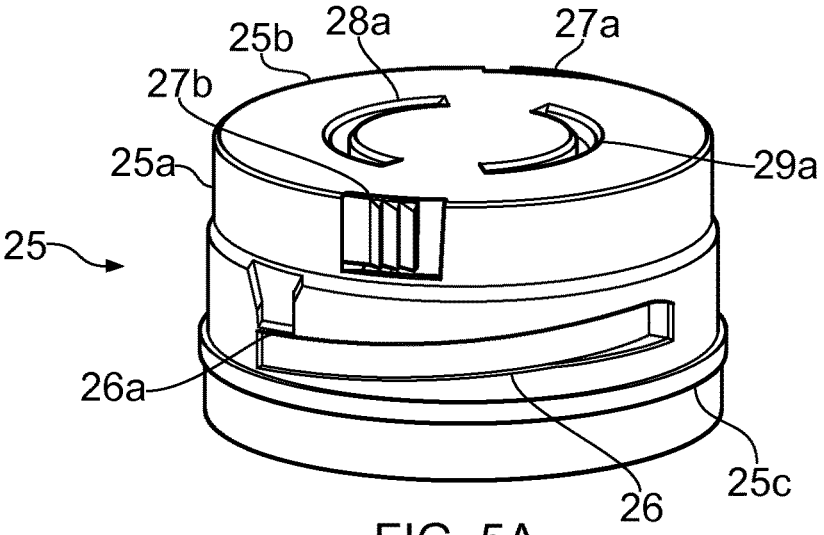
FIG. 5A is a perspective view of a first portion inner part of the closure.
Figure 5B:
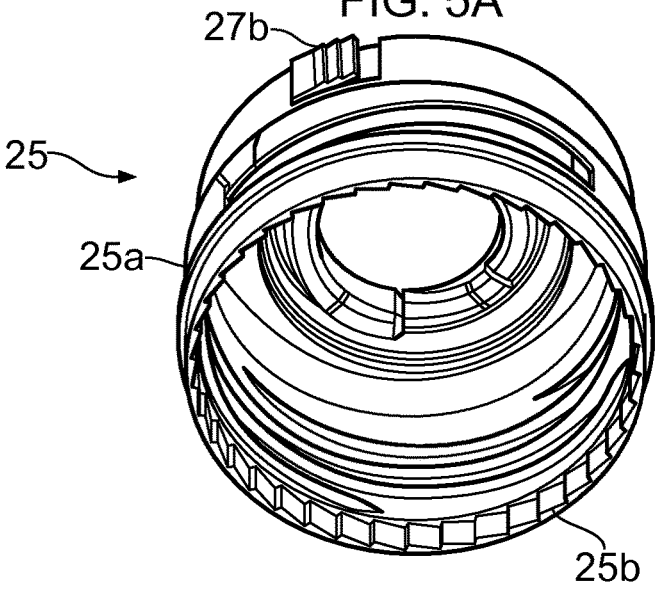
FIG. 5B is an underside perspective view of the inner part of FIG. 5A.
Figure 5C:
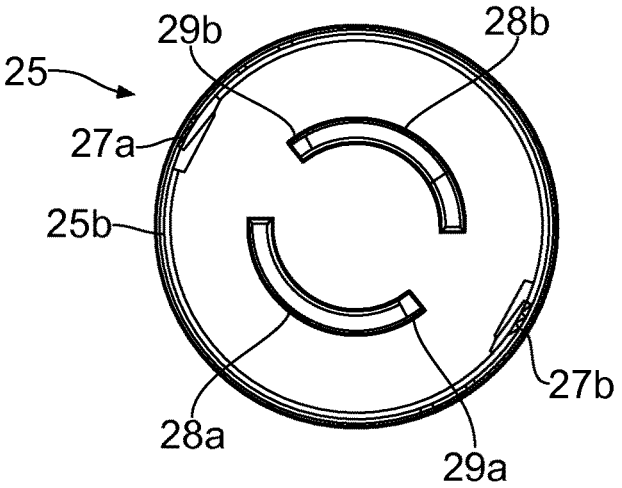
FIG. 5C is a plan view of the inner part shown in FIG. 5A.

Referring now to FIGS. 5A to 5C the inner part 25 is shown in more detail.

The inner part 25 is generally cup-shape with a cylindrical side wall 25*a* closed at one end by a top plate 25*b*.

The interior surface of the open end of the sidewall 25*a* includes a continuous series of ratchet teeth 25*b* which engage the ratchets 23 on the main body portion 22.

The exterior of the sidewall 25*a* includes two inclined side ramps 26. At the start of each ramp 26 is a locking step 26*a* the purpose of which will be described in more detail below.

The sidewall 25*a* also comprises a pair of ratchet members 27*a*, 27*b* adjacent the top plate 25*b*.

The exterior surface of the sidewall 25*a* also comprises a circumferential bead 25*c* the purpose of which will be described in more detail below.

The top plate 25*b* comprises a pair of opposing arcuate ramps 28*a*, 28*b* each of which terminates with a locking recess 29*a*, 29*b*.

Figure 6A:
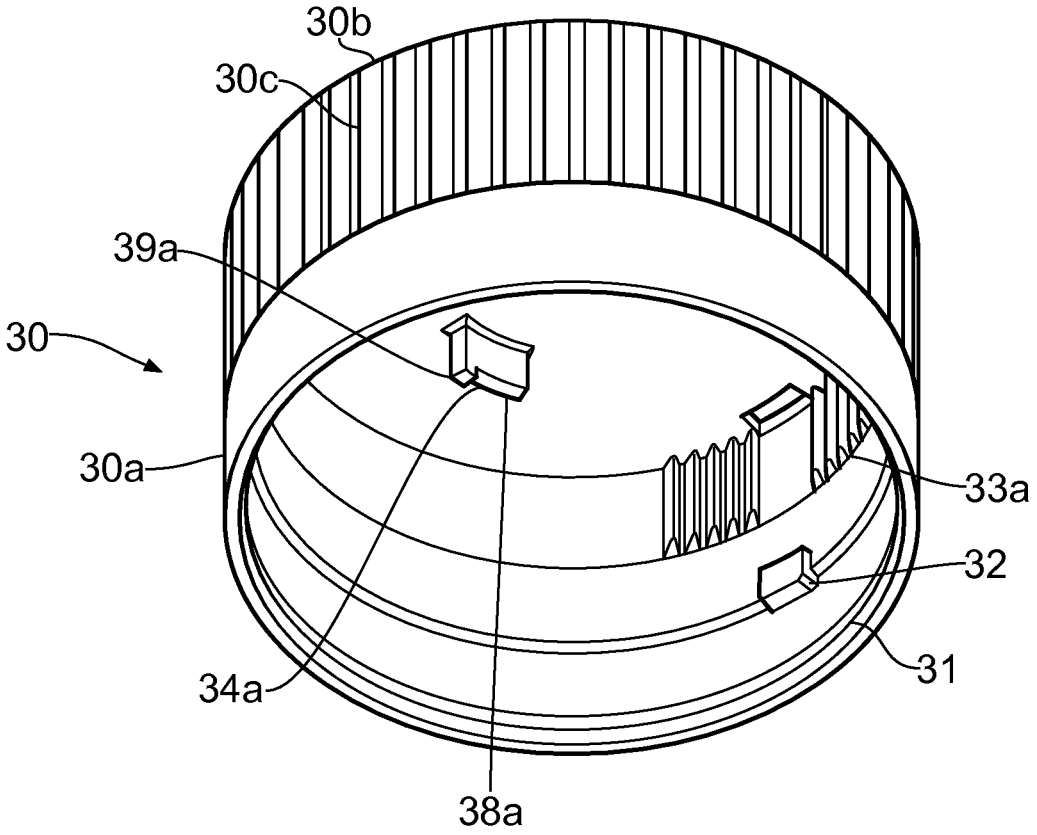
FIG. 6A is an underside perspective view of a first portion outer part of the closure.
Figure 6B:
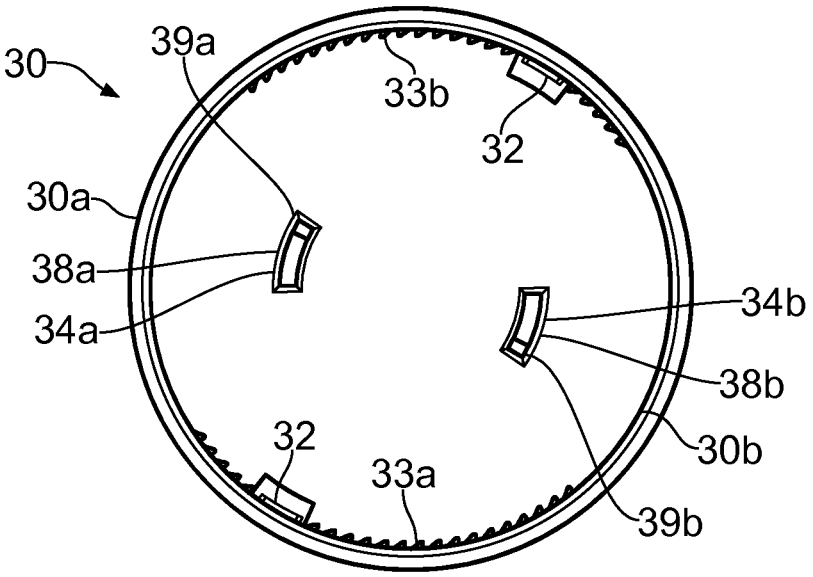
FIG. 6B is an under planned view of the outer part of FIG. 6A.

Referring now to FIGS. 6A and 6B the outer part 30 is shown in more detail.

The part 30 is generally cup-shape and comprises a cylindrical side wall 30*a* and a top plate 30*b*.

The exterior of the part 30 comprises a plurality of knurls 30*c* which help to lock the shell part 37 and to prevent relative rotation.

The interior of the sidewall 30*a* comprises a circumferential bead 31 for preventing the outer part 30 being lifted off the inner part by engagement with the corresponding bead 25*c*.

The interior of the sidewall 30*a* also comprises a pair of drive dogs 32 which engage in the ramps 26 of the inner part 25 and ride up them as the outer part 30 is rotated relative to the inner part 25.

The interior of the side wall 38 also comprises a pair of diametrically opposed ratchet arrangements 33*a*, 33*b* designed and positioned to run over and lock onto the corresponding ratchet arrangements 27*a*, 27*b* on the inner part 25 to prevent counter rotation.

The underside of the top plate 30*b* includes a pair of drive dogs 34*a*, 34*b* each of which comprises a main body 38*a*, 38*b* and a locking tooth 39*a*, 39*b*.

Figure 7A:
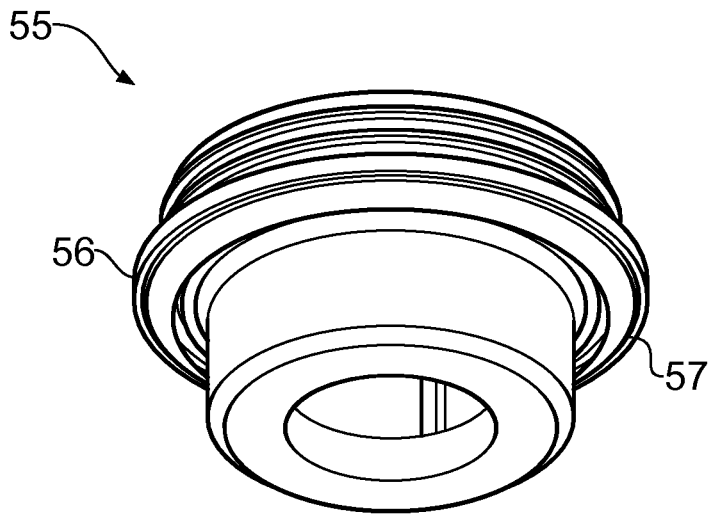
FIG. 7A is a perspective view of a valve housing forming part of the closure.
Figure 7B:
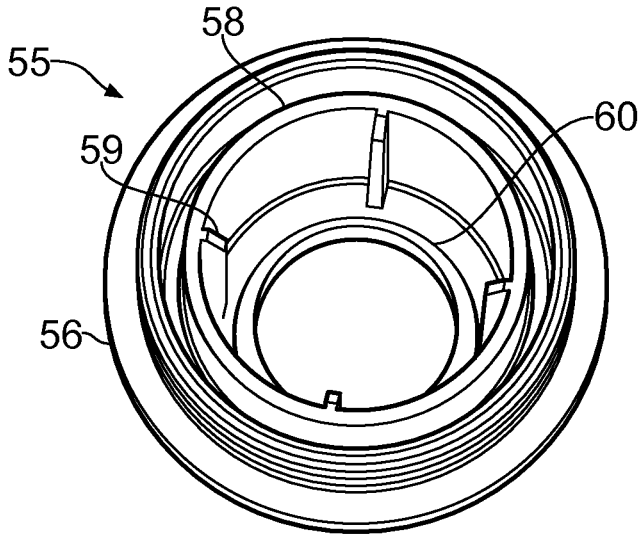
FIG. 7B is a further perspective view of the valve housing of FIG. 7A.

Referring now to FIGS. 7A and 7B a valve housing 55 is shown in more detail.

The housing 55 comprises a generally cylindrical body having a circumferential sealing flange 56 with a depending sealing lip 57 (sometimes referred to as a "crabs claw").

The exterior of the housing includes two circumferential beads 61, 62 which are used to clip the housing into the body 20 (as shown in FIG. 1).

The interior of the housing 55 comprises a valve chamber 58 having four locating ribs 59 and a valve seat 60.

Figure 8A:
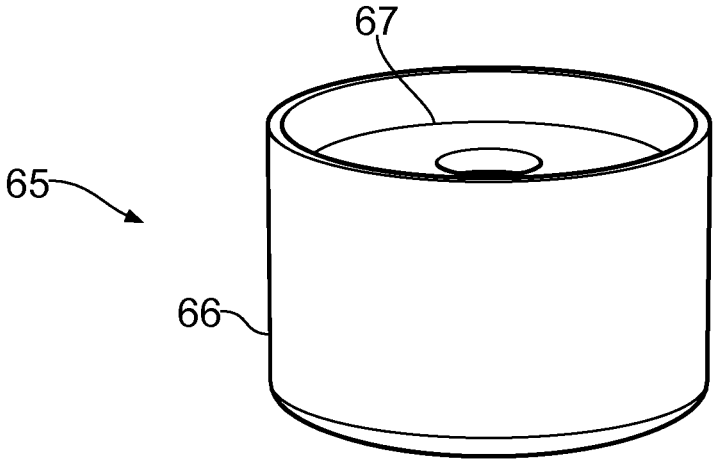
FIG. 8A is a perspective view of a valve member forming part of the closure.
Figure 8B:
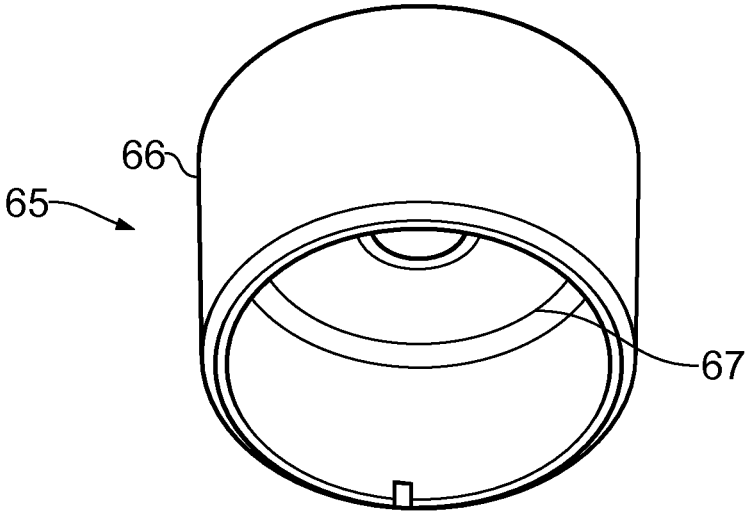
FIG. 8B is a further perspective view of the valve member of FIG. 8A.

Referring now to FIGS. 8A and 8B a float valve 65 is shown in more detail.

The valve 65 comprises a generally cup-shape body comprising a cylindrical side wall 66 and a recessed top plate 67.

The operation of the closure will now be described in more detail.

Initially the body 20 is locked on to the neck 15 be the ribs 21*b* to prevent axial and rotational movement. The inner part 25 cannot rotate relative to the body 20 by virtue of the ratchets 23, 25*b*. The shell part 37 cannot rotate relative to the outer part by virtue of the knurls 30*c*. The outer part 30 cannot be lifted off the inner part 25 by virtue of the locking beads 25*c*, 31 and by virtue of the drive dogs 32 engaging under the steps 26*a*.

The shell part 37 is grasped by a user and turned. This causes the outer part 30 to rotate relative to the inner part 25. The drive dogs 32 in the outer part rise up the ramps 26 in the inner part and the drive dogs 34*a* rise up the ramps 28*a*, 29*a*. The ratchets 33*a* pass over the ratchets 27*a*, 27*b*.

The outer part is caused to rise by 2 mm. At this point continued rotation causes the locking teeth 39*a*, 39*b* to drop into the locking recesses 29*a*, 29*b*. In addition, the ratchets 33*a* have rotated beyond the ratchets 27*a*, 27*b*. The inner part drops back down by 0.5 mm.

Continued rotation of the outer part relative to the inner part is not possible because the drive dogs 32 abut against the end of the ramps 26 and the drive dogs 34*a*, 34*b* abut against the end of the ramps 28*a*, 28*b*.

In this second position the open end of the outer part 30 has moved axially away from the open end of the inner part 25 to expose the free end of the sidewall 25*a*.

Continued rotation of the cap part (the shell part 37, the outer part 30 and in the inner part 25) overcomes the torque required to allow the ratchets 25 to pass over the ratchets 23 which causes the inner part to rotate relative to the body. The internal screw threads 25*d* on the inner part rise up the external screw threads 22*a* of the body.

The cap part can now be lifted off the body 20 to allow the contents of the container to be dispensed.

The contents are dispensed through the valve housing 55. The valve 65 lifts off the seat 60 as the container is upturned and contents flow out. The valve 65 re-seals against the seat 60 under the weight of the ball 70 when the container is returned to an upright position. This prevents re-filling of the container.

When the cap part is returned the inner part 25 is screwed back onto the body 20. The inner part screws back down to its original position, but the outer part cannot because it is locked in position both by the axial locking means provided by the drive dogs 34*a,* 34*b* and the lateral locking means provided by the ratchets 33*a,* 33*b* and 27*a,* 27*b.* This means that the gap G is formed between the shell parts 36, 37 with free end of the inner part skirt visible through it. This irreversible opening event provides visual evidence that the closure has been opened at least once. The gap G cannot be closed without destroying the closure.

Because the gap G between the metal shell parts 36, 37 is not generated by placing an obstruction directly between them, it is not possible to close the gap G by a simple cutting operation.

By providing the dual axial and lateral ratchet arrangements, re-setting closure back to its original position to close the gap G is prevented. Alternatively a similar closure is provided with just an axial ratchet arrangement.

Figure 9:
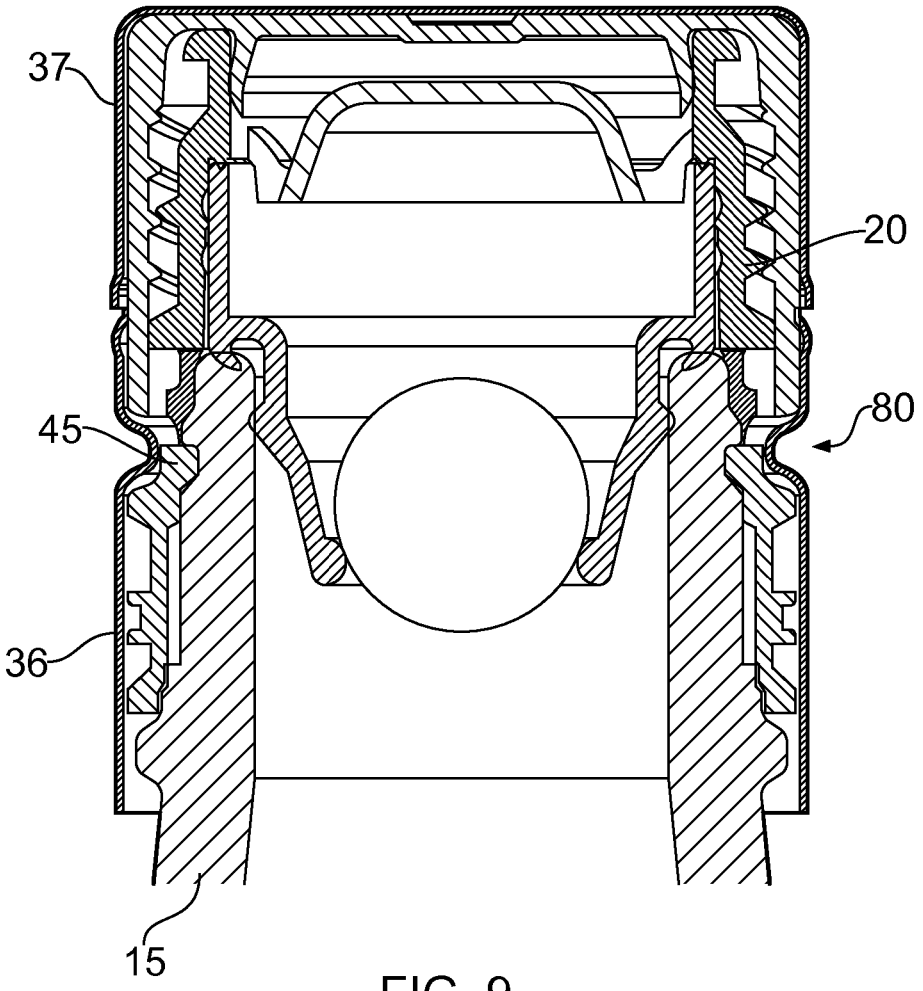
FIG. 9 is a section of a closure formed according to the present invention in a first, unopened position.
Figure 10:
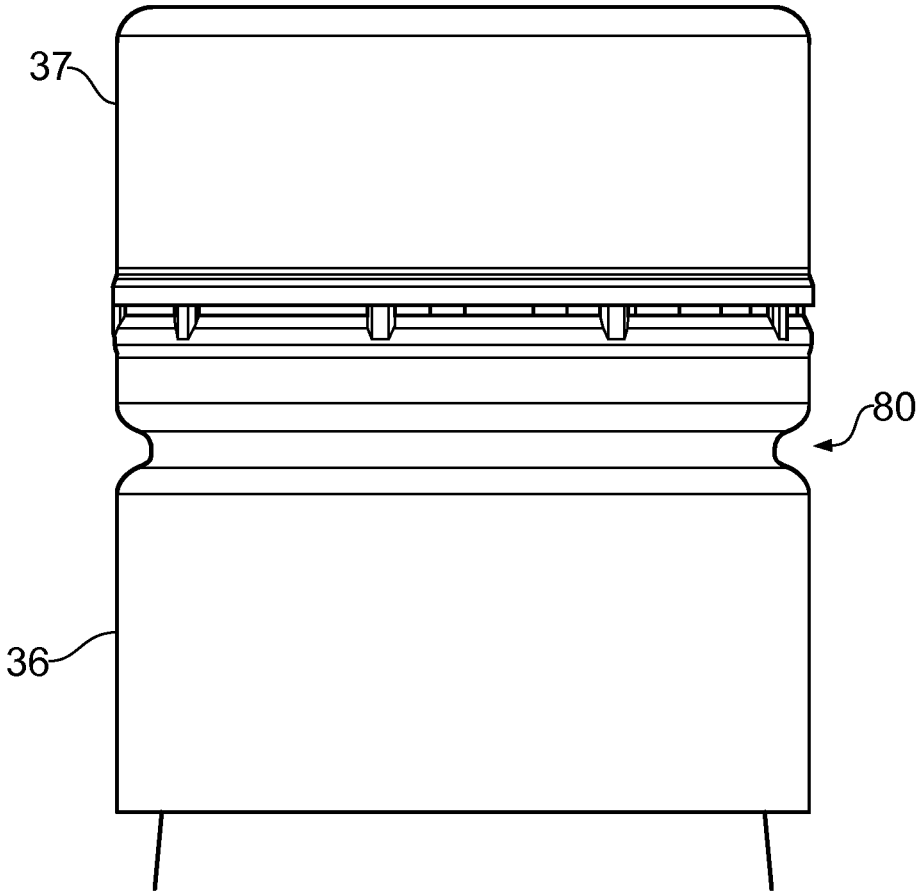
FIG. 10 is a side elevation of the opened closure shown in FIG. 1.
Figure 11:
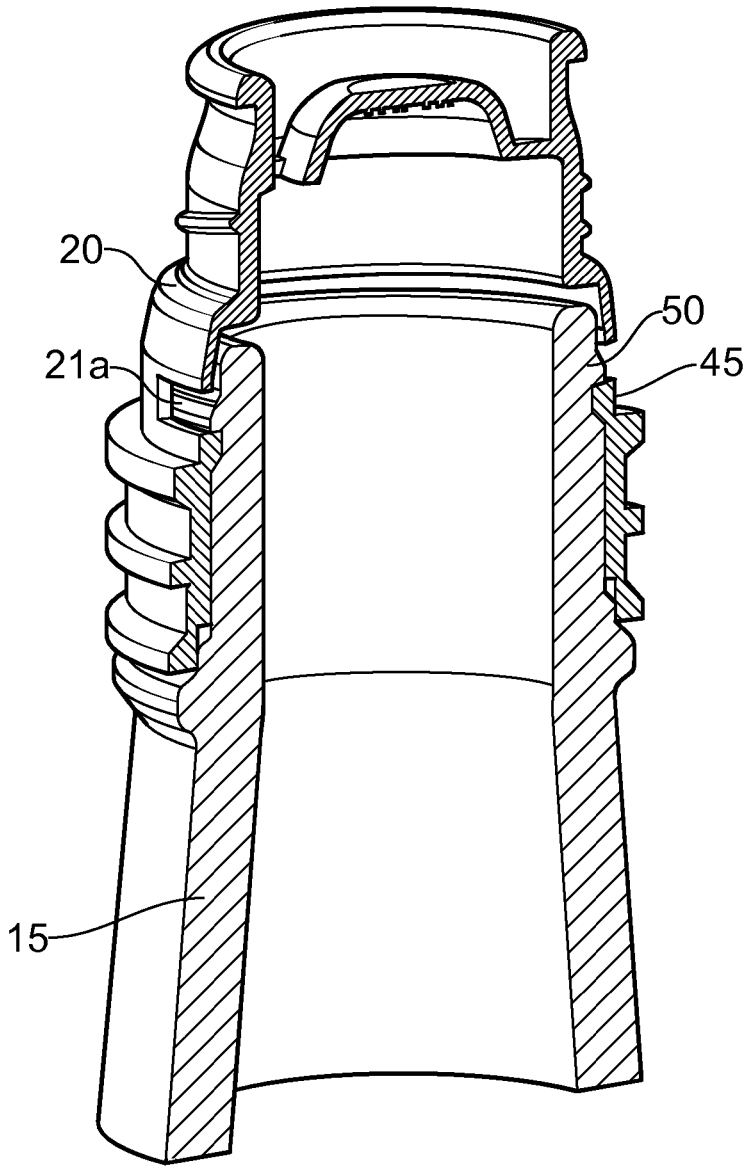
FIG. 11 is a section of the container and main body portion.
Figure 12:
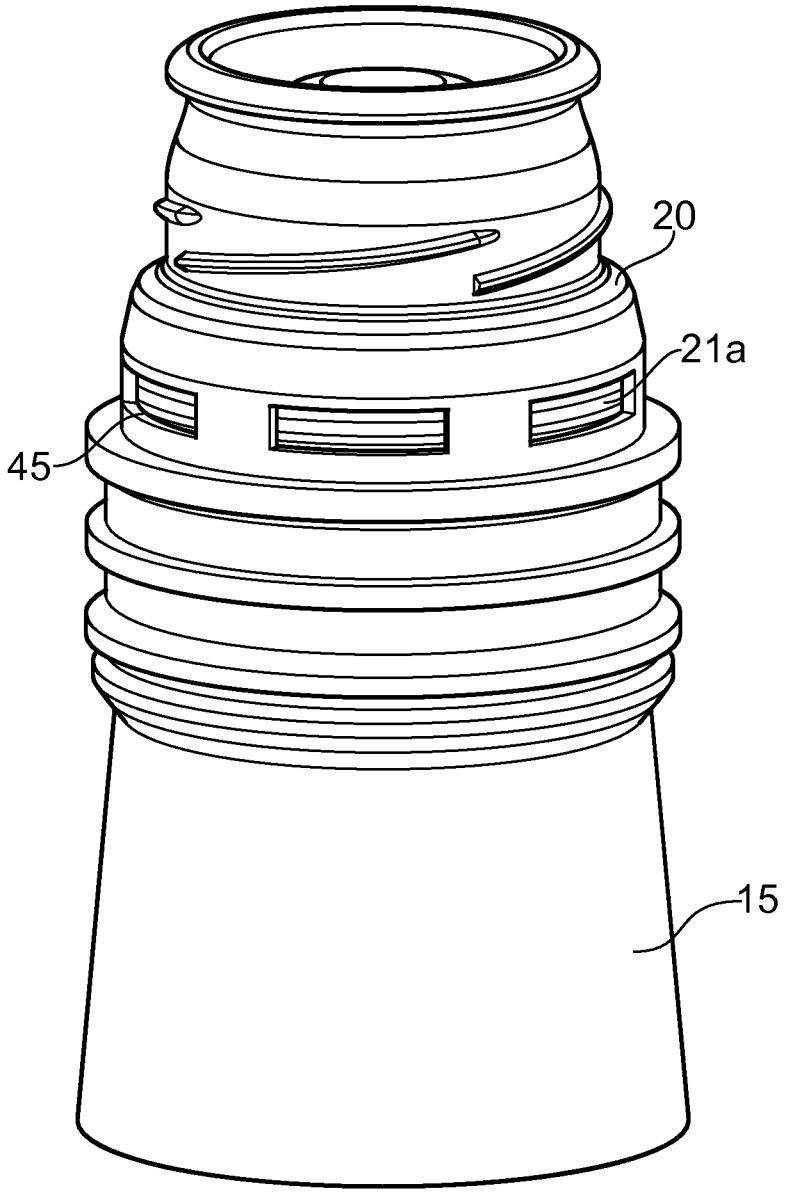
FIG. 12 is a perspective view of the closure of FIG. 11.

FIGS. 9 and 10 show an embodiment of the invention, in which a bead 80 formed in the shell part 36, is shown. The bead 80 comprises securing means. FIGS. 11 and 12 show in more detail how the main body 20 engages with the container 15. The securing means comprises at least one clip 45. Each clip 45 comprises a window 21*a* which has at a lower edge a ledge 45 for engagement under the container neck shoulder 50.

As can be seen, the bead 80 is positioned such that in use it urges the clips into engagement with the container neck 15 under the container neck shoulder 50, and thereby prevents the main body 20 from being removed from the container neck 15. The body portion 20 may be a pourer fitment.

The shell part may be made from metal and the bead 80 may be rolled on by the capping head on after assembly at the bottling hall.

By providing the bead 80 to secure the clips 45 of the body portion 20 to the container 15, the body portion 20 is securely coupled to the container so that it cannot be removed once the closure is applied to the container. As the main body is securely fastened to the container by the bead 80, instead of being made from a material of high strength such as polycarbonate, the main body may be made of a lower strength material, such as PET for example. This is because the bead 80 will ensure that if the closure is attacked by heat, for example with a hair dryer, in an attempt to deform the PET body portion to remove it from the container, the bead 80 will hold the clips of the body portion 20 in place on the container 15 to prevent removal of the body portion 20 from the container.

Although the above describes that the body portion is made of PET, it should be appreciated that the body portion may be made of polycarbonate or other plastics material.

It should be appreciated that although the above describes the use of a bead 80 to secure clips 45 of the body portion 20 to the container 15 in a container having a gap generator, it would be apparent that the invention is equally applicable to containers in which no gap generator is used, to secure a main body (pourer) to a container.

The invention claimed is:

1. A closure comprising:

a body portion having engagement means for engagement with a container to prevent removal of the body portion from the container, wherein the engagement means comprises at least one clip for securing the body portion to a neck of the container, and wherein the body portion is made from plastic, and a shell for engagement with the body portion, wherein the shell comprises securing means arranged in use to secure the engagement means onto the container, and wherein the securing means is a bead, wherein the shell is made from metal;

wherein the bead secures the at least one clip to the container so that the body portion cannot be removed from the container after the closure has been applied to the container.

2. The closure of claim 1, wherein the body portion is a pourer fitment.

3. The closure of claim 1, wherein the bead is arranged such that, in use, it urges the at least one clip into engagement with the neck of the container.

4. The closure of claim 1, wherein the at least one clip comprises a projection extending away from the body portion to engage the neck of the container.

5. The closure of claim 4, wherein the bead is arranged such that, in use, it urges the projection into engagement with the neck of the container.

6. The closure of claim 1, wherein the container is a bottle.

7. The closure of claim 1, wherein the body portion is made of polycarbonate.

8. The closure of claim 1, wherein the body portion is made of polyethylene terephthalate.

9. The closure of claim 2, wherein the at least one clip secures the pourer fitment to the neck of the container.

10. The closure of claim 9, wherein the bead is arranged such that, in use, it urges the at least one clip into engagement with the neck of the container.

11. The closure of claim 9, wherein the at least one clip comprises a projection extending away from the pourer fitment to engage the neck of the container.

12. The closure of claim 1, wherein the shell forms an outer casing comprising a cylindrical lower part and a cup-shaped upper part, the cylindrical lower part and the cup-shaped upper part separated at a split line, and the cylindrical lower part comprising the bead.

13. The closure of claim 1, wherein the body portion comprises a lower engagement portion and an upper flow regulation portion, and the lower engagement portion comprises the at least one clip.

14. The closure of claim 1, wherein the at least one clip comprises a window which has, at a lower edge, a ledge for engagement under a shoulder of the neck of the container.

15. The closure of claim 14, wherein the bead is arranged such that, in use, it urges the at least one clip into engagement with the neck of the container.

* * * * *